United States Patent [19]

Kuhn et al.

[11] Patent Number: 5,006,208

[45] Date of Patent: Apr. 9, 1991

[54] GALVANIC GOLD ALLOYING BATH

[75] Inventors: Werner Kuhn, Rodenbach; Wolfgang Zilske, Hanau, both of Fed. Rep. of Germany

[73] Assignee: Degussa Aktiengesellschaft, Frankfurt, Fed. Rep. of Germany

[21] Appl. No.: 574,359

[22] Filed: Aug. 29, 1990

[30] Foreign Application Priority Data

Sep. 6, 1989 [DE] Fed. Rep. of Germany ..... 3929569

[51] Int. Cl.[5] ..... C25D 3/62

[52] U.S. Cl. ..... 204/44

[58] Field of Search ..... 204/44

[56] References Cited

U.S. PATENT DOCUMENTS 3,532,610 10/1970 DuRose ..... 204/52.1
3,586,611 6/1971 Heilmann ..... 204/44
4,687,557 8/1987 Emmenegger ..... 204/44

FOREIGN PATENT DOCUMENTS 651976 12/1964 Belgium .
20191 2/1981 Japan .
847949 9/1960 United Kingdom .

*Primary Examiner*—G. L. Kaplan
*Attorney, Agent, or Firm*—Beveridge, DeGrandi & Weilacher

[57] ABSTRACT

Yellow to rose-colored gold alloy coatings with copper and silver are obtained from stable galvanic baths with a pH of 8.5 to 11 containing, 1 to 15 g/liter gold as potassium gold (I) cyanide, 5 to 50 g/liter copper as potassium copper (I) cyanide, 0.05 to 5 g/liter silver as potassium silver (I) cyanide and dipotassium hydrogenphosphate as well as alkali cyanides in amounts of up to 10 g/liter and 0.1–1 mg/liter potassium selenocyanate.

5 Claims, No Drawings

GALVANIC GOLD ALLOYING BATH

INTRODUCTION AND BACKGROUND

The present invention relates to a galvanic gold alloying bath which contains 1 to 15 g/liter gold as potassium gold (I) cyanide, 5 to 50 g/liter copper as potassium copper (I) cyanide, 0.05 to 5 g/liter silver as potassium silver (I) cyanide, free alkali cyanide, dipotassium hydrogenphosphate as well as a selenium compound and exhibits a pH of 8.5 to 11.

The galvanic plating and deposition of gold alloys has achieved special significance for decorative and industrial purposes. The soft, light yellow, matte layers of pure gold can be varied in many ways in respect of their physical properties, for example, luster or brightness, hardness, wear resistance or color, by means of the coplating of other metals. A considerable part of the plated, gold-alloy coatings is constituted by 14–18 carat, yellow or rose-colored gold coatings containing, in addition to copper as an alloying metal, a metal which imparts a white color such as cadmium, silver or zinc in order to brighten the red tone caused by the copper.

Such coatings are used for example in the jewelry trade and in the eyeglass industry, where double layers have been largely replaced by galvanic coatings. However, such coatings are also used in electronic technology applications if no low contact resistance is necessary, such as for example in the case of slip-ring contacts and rotary contacts.

The galvanic plating of gold/copper/silver alloy coatings poses considerable difficulties on account of the potential position of the metals in the electrolyte. Ways to solve these difficulties have not been altogether unsatisfactory up to the present. The basis for the common plating system are aqueous solutions of the cyanocomplexes of the three metals. In the alkaline range, in which these baths are only stable, the potential of silver is considerably more electropositive than that of gold and copper. This means that silver is preferentially plated out and therefore only coatings with a whitish-yellow or greenish-yellow color, depending on the silver content, are obtained. An attempt was therefore made in DE-PS 801,312 to shift the potential of silver to less electropositive, or less noble, values by using as low a pH as possible. However, at the indicated pH of 7, the free alkali cyanide required to stabilize the cyanocomplexes of the three metals is no longer stable. Furthermore, the concentration changes constantly which results in a constant changing in the composition of the plated alloy. Other prior art attempts, such as DD-PS 59022, likewise are carried out in the neutral range and efforts to obtain lustrous layers by means of using alternating current at a low concentration of free alkali cyanide frequently results in practice in obtaining coatings with an uneven color.

In alkaline baths, the formation of luster or brightness in the coatings can also be achieved with chemical compounds. According to DE-PS 750,185, selenium compounds or tellurium compounds impart luster in the plating of silver coatings or copper coatings from an alkaline cyanide bath.

SUMMARY OF THE INVENTION

An object of the present invention is to provide a galvanic gold alloying bath which contains 1 to 15 g/liter gold as potassium gold (I) cyanide, 5 to 50 g/liter copper as potassium copper (I) cyanide, 0.05 to 5 g/liter silver as potassium silver (I) cyanide, free alkali cyanide, dipotassium hydrogenphosphate as well as a selenium compound and exhibiting a pH of 8.5 to 11 which is stable and furnishes gold-copper-silver alloy coatings which are lustrous and, depending on the copper content and current density, yellow to rose-colored without expensive auxiliary materials.

In achieving the above as well as other objects, one feature of the invention resides in controlling the content of free alkali cyanide to at most 10 g/liter and including 0.1 to 1 mg/liter selenium as potassium selenocyanate in the alloying bath. The alkali cyanide can be any alkali metal cyanide, although potassium cyanide is preferred.

The bath preferably also contains 0.1 to 5 ml/liter of a surface active agent from the group of the non-ionic wetting agents of the ethylene oxide adduct type and their phosphate esters. Alkylpolyglycol ether, butyl- or nonylphenolpolyglycol ether and their phosphate esters are examples of well known materials that can be used for purposes of the invention.

It surprisingly turned out that in the weakly alkaline range at contents of free alkali cyanide $<10$ g/liter in combination with the brightener potassium selenocyanate, not only is the co-plating of a sufficient amount of copper possible and the bath exhibits stable conditions but the coatings are lustrous and ductile.

DETAILED DESCRIPTION OF THE INVENTION

The galvanic gold alloying baths of the invention are preferably composed as follows:

1–15 g/liter gold as $KAu(CN)_2$
5–50 g/liter copper as $K_2Cu(CN)_3$
0.05–5 g/liter silver as $KAg(CN)_2$
0.1–10 g/liter free alkali cyanide
1–10 g/liter di-potassium hydrogenphosphate
0.1–5 ml/liter surface active agent
0.1–1 mg/liter selenium as KSeCN A phosphate ester such as for example nonylphenolpolYglycol ether phosphate ester is suitable as the surface active agent which supports the formation of luster or brightness. The bath exhibits a pH of between 8.5 and 11 and is preferably operated at a bath temperature of 60°–75° C. and current densities of 0.2–2.5 A/dm$^2$.

The following bath composition is preferably used for the 14–18 carat yellow or rose-colored gold alloy coatings most frequently plated in practice:

3–5 g/liter gold as $KAu(CN)_2$
20–25 g/liter copper as $K_2Cu(CN)_3$
0.2–0.5 g/liter silver as $KAg(CN)_2$
2–4 g/liter free alkali cyanide
2–4 g/liter di-potassium hydrogenphosphate
0.1–1 ml/liter surface active agent
0.1–0.5 mg/liter selenium as KSeCN The bath is preferably operated at a pH of 9–10 and a bath temperature of 60°–70° C. Lustrous coatings are obtained in a current-density range between 0.3 and 1/5 A/dm$^2$, where the carat content of the layers decreases as the current density increases. The plated layers are very ductile. Even low-carat coatings exhibit a good corrosion resistance in a copper chloride test.

The following example is intended to explain the galvanic gold alloying bath of the invention in more detail:

In order to prepare one liter of bath, the following substances are dissolved one after the other in distilled water:

2 g potassium cyanide, 69.2 g potassium copper (I) cyanide, 7.5 g potassium cyanoaurate (I), 2 g di-potassium hydrogenphosphate, 0.46 g potassium dicyanoargentate and 0.18 mg potassium selenocyanate. 0.1 ml nonylphenolpolyglycol ether phosphate ester wetting agent is added thereto in a dilution of 1:5 and, finally, the bath is filled with water to 1 liter.

The pH is adjusted with potassium hydroxide to 9. The bath is now heated to 65° C. and a prepared, bright nickel-plated copper sheet is gilded 2.5 Amin at a current density of 0.5 A/dm$^2$. The result is a lustrous coating with a slight rose-colored tint which exhibits a carat content of 17.2.

Further variations and modifications of the foregoing will be apparent to those skilled in the art and are intended to be encompassed by the claims appended hereto.

German application P 39 29 569.9 is relied on and incorporated herein by reference.

We claim:

1. A galvanic gold alloying bath comprising 1 to 15 g/liter gold as potassium gold (I) cyanide, 5 to 50 g/liter copper as potassium copper (I) cyanide, 0.05 to 5 g/liter silver as potassium silver (I) cyanide, free alkali cyanide, dipotassium hydrogenphosphate and potassium selenocyanate.

2. The galvanic gold alloying bath according to claim 1, further comprising 0.1 to 5 ml of a surface active agent selected from the group consisting of non-ionic wetting agents of the ethylene oxide adduct type and their phosphate esters.

3. The galvanic gold alloying bath according to claim 1, which exhibits a pH of 8.5 to 11.

4. The galvanic gold alloying bath according to claim 1, wherein the content of free alkali cyanide in the bath is up to 10 g/liter.

5. The galvanic gold alloying bath according to claim 1 wherein the content of selenocyanate is 0.1 to 1 mg/l selenium.

* * * * *